US010548802B2

(12) United States Patent
Aslani et al.

(10) Patent No.: US 10,548,802 B2
(45) Date of Patent: Feb. 4, 2020

(54) MECHANICAL LOWER LIMB ASSISTIVE DEVICE

(71) Applicants: Shervin Aslani, Toronot (CA); Bradley Randal Abbott Holder, Dutton (CA); Michael Jeffrey Thomas Ackworth, St. Thomas (CA); Francisco Espino Valenzuela, Kitchener (CA)

(72) Inventors: Shervin Aslani, Toronot (CA); Bradley Randal Abbott Holder, Dutton (CA); Michael Jeffrey Thomas Ackworth, St. Thomas (CA); Francisco Espino Valenzuela, Kitchener (CA)

( * ) Notice: Subject to any disclaimer, the term of this patent is extended or adjusted under 35 U.S.C. 154(b) by 205 days.

(21) Appl. No.: 15/637,886

(22) Filed: Jul. 12, 2017

(65) Prior Publication Data

US 2018/0078443 A1 Mar. 22, 2018

Related U.S. Application Data

(60) Provisional application No. 62/493,570, filed on Jul. 11, 2016.

(51) Int. Cl.
*A61H 3/00* (2006.01)
*A63B 21/00* (2006.01)

(52) U.S. Cl.
CPC ..... *A61H 3/00* (2013.01); *A63B 21/4011* (2015.10); *A61H 2003/007* (2013.01); *A61H 2201/1261* (2013.01)

(58) Field of Classification Search
CPC ..... A61H 3/00; A61H 2003/007; A61H 2201/1261; A61H 3/08; A63B 21/4001; A63B 21/4011; A63B 21/4025; A63B 21/4027; A63B 21/4043
See application file for complete search history.

(56) References Cited

U.S. PATENT DOCUMENTS

| | | | | |
|---|---|---|---|---|
| 9,351,900 | B2 * | 5/2016 | Walsh | A61H 1/024 |
| 2013/0190147 | A1 * | 7/2013 | Luo | A63B 21/0552 482/122 |
| 2015/0190669 | A1 * | 7/2015 | Matsuura | A63B 21/02 482/8 |
| 2018/0093374 | A1 * | 4/2018 | Holgate | B25J 9/1075 |
| 2018/0200572 | A1 * | 7/2018 | Wagner | A63B 23/0233 |

* cited by examiner

*Primary Examiner* — Kristen Matter
(74) *Attorney, Agent, or Firm* — Matthew Thurlow

(57) ABSTRACT

A variety of implementations, building off one another, of a device that mechanically provides energy to muscles used throughout the gait cycle. The mechanical power is provided by elastic bands, or similar material. The different implementations presented introduce more components which provide adjustability in many aspects of the device including how it fits the user, increasing comfort for the user, and providing customized tension levels, thus customized assistance, in the different segments of the device thus to the different muscle groups in the lower extremity.

6 Claims, 5 Drawing Sheets

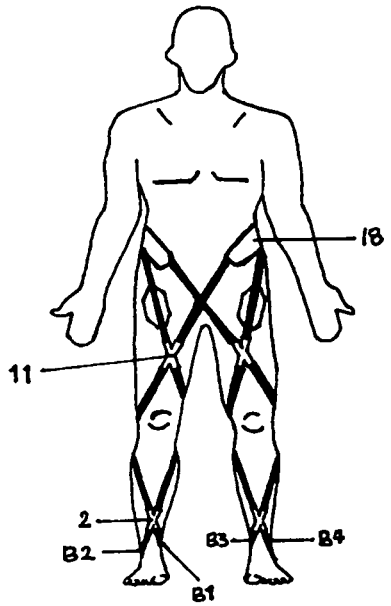
FIG 2 - A
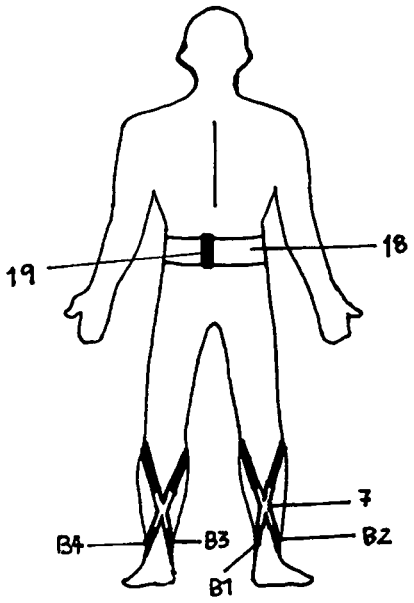
FIG 2 - B

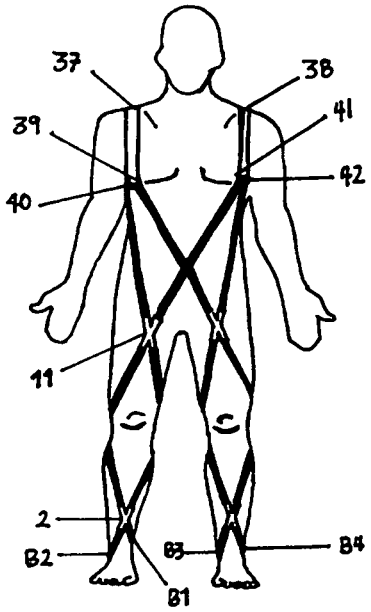
FIG 3 - A
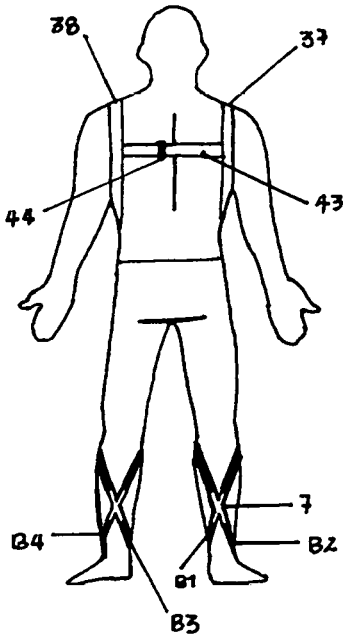
FIG 3 - B

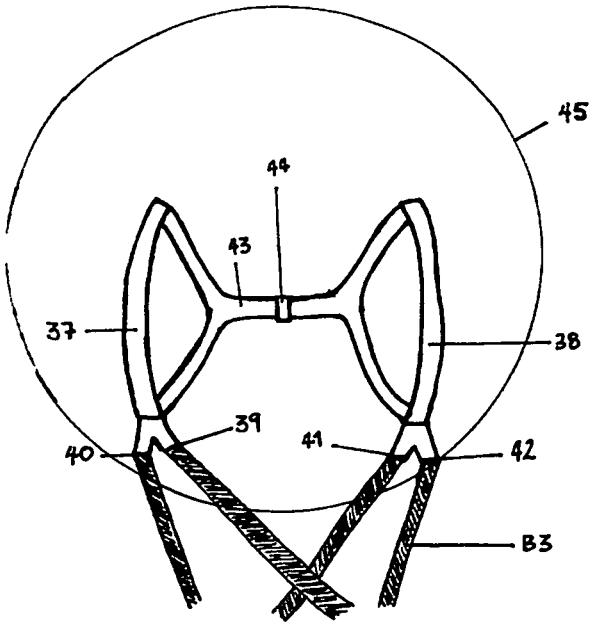
FIG 4
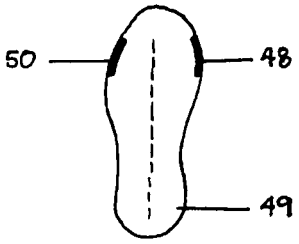
FIG 5 – A
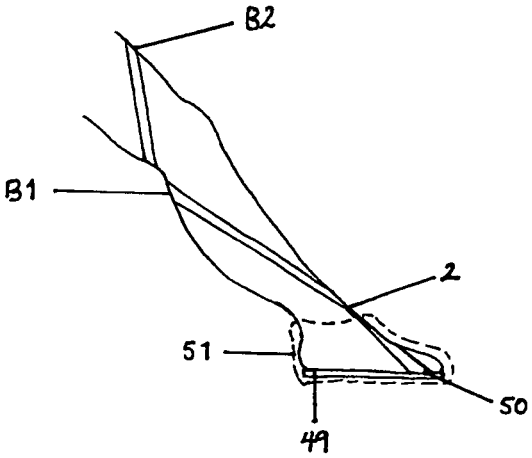
FIG 5 -B

MECHANICAL LOWER LIMB ASSISTIVE DEVICE

CROSS-REFERENCE TO RELATED APPLICATIONS

This Application claims priority to U.S. Provisional Patent Application No. 62/493,570, the contents of which are hereby incorporated herein by reference in their entirety.

STATEMENT REGARDING FEDERALLY SPONSORED RESEARCH OR DEVELOPMENT

N/A

THE NAMES OF THE PARTIES TO A JOINT RESEARCH AGREEMENT

N/A

REFERENCE TO A SEQUENCE LISTING

N/A

STATEMENT REGARDING PRIOR DISCLOSURES BY THE INVENTOR OR JOINT INVENTORS

N/A

FIELD

This invention relates to the field of walking/running assistance, for the purpose of assisting human walking/running, and particularly to wearable devices that provide external energy to actively assist the leg muscles fulfill their function, minimize metabolic cost, improve range of motion, and correct gait cycle abnormalities during the swing phase of the walking cycle.

BACKGROUND OF THE INVENTION

This invention relates to a wearable device that works synergistically with the natural human bio-mechanics for assisting human walking. The device provides mechanical energy during the swing phase of the walking (gait) cycle to assist the leg muscles fulfil their function and improve range of motion by promoting knee, hip and ankle flexion.

Loss of mobility is a critical result of aging that can have devastating effects on the quality of life and independence of elderly persons. As the leg muscles become weaker, due to aging, the walking abilities of elderly individuals degrade leading to reclusive and inactive lifestyles. This in turn, leads to a number of psychological and physiological consequence that includes, but is not limited to depression, heart problems, obesity, etc. This invention is capable of restoring the normal walking abilities of elderly individuals, by mechanically providing assistance with step-to-step gait transitions and allowing them to maintain the quality of life and independence that would otherwise be affected by a loss of mobility.

Walking abnormalities are another critical factor that cause loss of mobility. Abnormalities in the walking pattern may be caused by genetics or other factors such as disease, injuries, trauma or neurological disorders. Many walking abnormalities disturb the muscles or nerves responsible for walking, affecting the patient's normal ability to pick up the leg and foot during the swing phase of the walking cycle. This invention is capable of assisting persons with walking abnormalities achieve a normal walking cycle by mechanically providing assistance with step-to-step gait transitions, and promoting natural leg motion. Simultaneously, this invention promotes rehabilitation for recovering patients by stimulating the muscles through repetitive movement, a method used by physiotherapists to assists in rehabilitation over time.

Similarly, metabolic muscle fatigue also causes certain loss of mobility in healthy individuals. As the muscles become fatigued, the normal abilities of muscles to generate force decreases, which in turn leads to temporary decreased performance. The ability to provide an individual high levels of consistent and prolonged muscle performance is important to a number of occupations that includes, but is not limited to: military recruits, police officers, firefighters, etc. However, it is not naturally feasible to maintain high levels of performance for extended periods, and performance is expected to continue to decrease gradually over time. This invention is capable of reducing muscle fatigue by generating forces that actively assist the leg muscles to fulfill their function, thereby reducing muscle exertion and reducing the metabolic cost of running and walking. Additionally, this invention is capable of generating forces that can compensate for the decreased ability of fatigued muscles to generate force, thereby improving performance of fatigued muscles. This invention is not only applicable to the mentioned occupations, others may include less physically demanding occupations that still require individuals to be standing and walk for extended periods of time. Some of these occupations may include, but are not limited to, a number of factory jobs, and construction site related occupations. This invention may also be used by any healthy individual for recreational and personal purposes related to walking and running to reduce muscle fatigue and increase performance, such activities include but are not limited to hiking, and jogging.

Currently the marketplace does not offer an affordable wearable product for the purpose of providing assistance to the leg muscles that can enhance the user's ability to walk, run or hike for extended periods of time. The ability to walk, run or hike for extended periods of time is important to a number of occupations, individuals with active lifestyles and individuals who wish to increase physical activity levels. While some devices do exist that can provide stability, support and leg muscle assistance, such as exoskeletons, these are largely unavailable to the general public, they are unaffordable, large in size, and complex. Exoskeletons are designed for specific applications, such as for quadriplegics, making them inappropriate for the average user. There are other instruments available that are used for walking, and hiking, such as trekking poles, but these are only meant to enhance stability and provide support. Without the ability to assist the muscles, fatigue will gradually develop that will limit the user's ability to walk, hike or run for extended periods of time. For individuals with weak leg muscles, this means a complete inability to engage in walking, hiking or running activities that require more effort, such as required for uneven and rocky terrains. Therefore, there is a need for a wearable device that can assist leg muscle function and increase the user's ability to walk, run or hike for extended periods of time. Furthermore, there is a need for an affordable and lightweight device, that is customizable to the specific needs of each user. This invention will be the first of it's kind invaluable to consumers who wish to increase their ability to walk, run, or hike for extended periods of time. This invention provides energy to assist the leg muscles without the need for electrical components or external power sources, resulting in a thin, comfortable and lightweight device. It is adjustable to offer a customized experience and may also be used with walking devices that provide support and stability.

In the field of mobility assistance for persons with walking disabilities there is a need for a device that can provide assistance to the leg and ankle muscles to achieve hip, knee and ankle flexion during the swing phase of the walking cycle. While there are devices available that promote ankle, hip and knee flexion, these devices cause abnormal walking patterns that users find undesirable. Furthermore, devices meant to be worn under clothing are uncomfortable and cannot conform to the user's silhouette causing odd looking shapes around the user's body, which the user's find undesirable. As such, it is apparent that there is need for device that can assist the leg muscles fulfil their function and achieve ankle, knee and hip flexion during the swing phase of the walking cycle. In addition, there is a need for the device to act in complete harmony with the normal human biomechanics to eliminate abnormal walking patterns. Finally, there is a need for a device that conforms to the user's silhouette to eliminate undesirable cosmetic effects, rendering the device inconspicuous. There is also a need for a device that is capable of providing assistance to those who have suffered from declining mobility abilities due the effects of aging. Such a device is capable of reducing the negative impacts of this effect and restoring healthy and active lifestyles. There is also a need for a device that is capable of providing assistance to those who suffer from walking abnormalities due to genetics or other factors such as disease, injuries, trauma or neurological disorders. Such a device is capable of assisting persons with walking abnormalities by mechanically providing assistance with step-to-step gait transitions, and promoting natural leg motion. There is also a need for a device that is capable of providing assistance to those who suffer from metabolic muscle fatigue. Such a device is capable of reducing muscle fatigue by generating forces that actively assist the leg muscles to fulfill their function. There is also a need for a device that is capable of providing individuals the ability to walk, run or hike for extended periods of time. Such a device would provide individuals the ability to maintain active lifestyles and individuals who wish to increase physical activity levels.

BRIEF SUMMARY OF THE INVENTION

1. The invention presented here is a wearable device that adds energy to the user's lower extremity muscles while working synergistically with the natural biomechanics of the human body to promote a natural assisted gait cycle. The device is made of:
   - i. An upper body attachment
     1. A belt
     2. A shoulder harness
   - ii. Two adjustable bands for each lower extremity with elastic properties
   - iii. A foot attachment
     1. A trimmable insole
     2. An external strap
2. The first embodiment of the invention being presented corresponds to the elastic bands being wrapped around the lower extremity in the proper cross form pattern with one end of each band being adjustably secured to the hip while the other end is adjustably secured to the forefoot. The proper placement of the bands provides energy to the groups of muscles responsible for hip flexion, knee flexion, and dorsiflexion of the ankle while maintaining the natural biomechanics of the lower limb.
3. A second embodiment of the invention presented is one where the upper body attachment consists of a semilunar belt with two attachment points lying on each hip thereby ready to receive bands to assist both lower extremities simultaneously
   - i. The belt is adjustable to be configured properly to the circumference of the user's waist.
   - ii. The belt is secured through tension of the elastic bands and by sitting correctly on the hips.
   - iii. When configured properly the belt provides support to restore and maintain a neutral hip throughout the gait cycle.
4. A third embodiment of the present invention corresponds to the upper body attachment being a shoulder harness that, similar to the semilunar belt, provides 4 attachment points, ready to receive bands to assist the left and right lower extremities simultaneously
   - i. The shoulder harness is adjustable to be configured properly to the size and shape of the user's upper body.
   - ii. The shoulder harness is secured through tension of the elastic bands and through being wrapped around the shoulder, and a strap on the back of the user.
5. A fourth embodiment of the invention being presented contains sectional elastic bands. The bands consist of elastic force providing segments bonded to fixed length segments intermittently.
   - i. There is no limit to the number of each segment type.
   - ii. Each band has an adjustable clip on each end to provide the ability for increasing and decreasing tension, as well as securing to the foot attachment and upper body attachment.
   - iii. Each resulting band is a continuous band with intermittent elastic force providing segments.
6. A fifth embodiment of the present invention utilizes "crossing clips" to hold and secure the 3 locations that the present invention calls for crossing of the two elastic bands.
   - i. The clips are adjustable to secure crossing points on each of the quadricep, the gastrocnemius, and one in front of the tibialis anterior.
7. A sixth embodiment of the present invention consists of a strap/wrap that goes around the exterior of a shoe or the foot to provide two attachment points for the elastic straps to the foot/forefoot area.
   - i. The bottom of the strap contains a surface with reduced friction.
8. A seventh embodiment of the present invention consists of a trimmable insole to place in the shoe which provides two attachment points on the bottom/side of the ball of the foot.
   - i. The insole attachment points will guide the bands through the side of the shoe as to not place high amounts of pressure on the user's foot inside the shoe.
9. An eighth embodiment of the invention presented utilizes pressure dispersion pads.
   - i. The pressure dispersion pads may be in an 'x' cross formation to use at band crossover locations.
   - ii. The pressure dispersion pads may also take a lowercase "I" formation along stretches of single elastic band that may come into contact with the user's body.

BRIEF DESCRIPTION OF THE SEVERAL VIEWS OF THE DRAWING

FIG. 2-A. Shows the present invention from the front view on a user, with two devices (both legs assisted), attached to one semilunar belt.

FIG. 2-B. Shows the present invention from the rear view on a user, with two devices (both legs assisted), attached to one semilunar belt.

FIG. 3-A. Shows a user with two devices (both legs assisted) attached to one shoulder harness from the front view.

FIG. 3-B. Shows a user with two devices (both legs assisted) attached to one shoulder harness from the rear view.

FIG. 4. Presents the shoulder harness not on a user and shows the connections is makes to the assistive device on each lower extremity.

FIG. 5-A. Presents the Insole foot attachment from the bottom.

FIG. 5-B. Presents the Insole foot attachment on a user from the side view

DETAILED DESCRIPTION OF THE INVENTION

Figure 1:
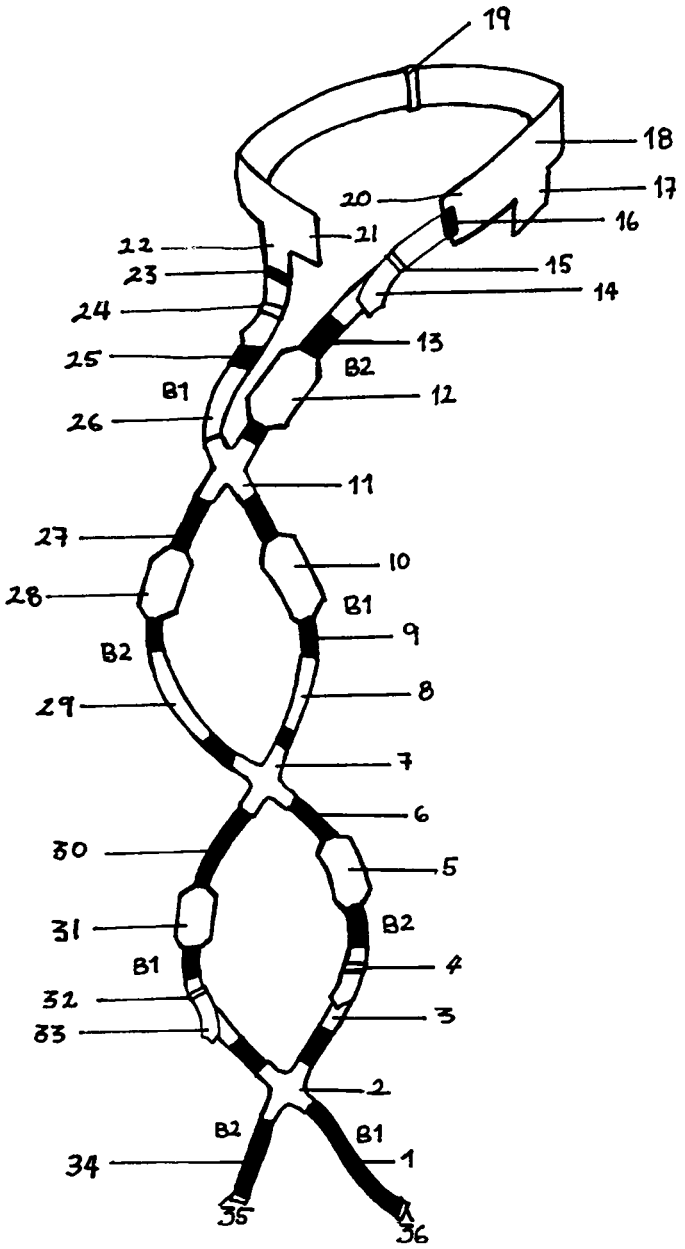
FIG. 1. Shows an overview of the device without the foot attachment portion and not on a user.
Figure 6:
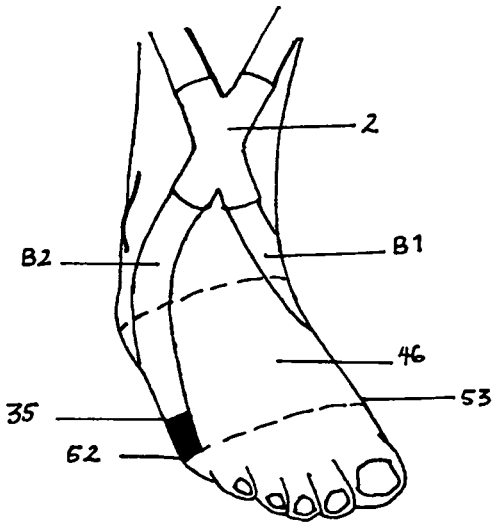
FIG. 6. Shows the foot wrap foot attachment on a user.

1. The description provided below is meant as an example and is not intended to limit the scope of the invention presented.
2. FIG. 1 shows the first embodiment of the present invention, which is worn on one lower extremity to provide assistance in the walking (gait) cycle. The device consists of an upper body attachment, either a semilunar belt 18, or a shoulder harness, two continuous elastic bands wrapped in a specific manner, and a foot attachment (not shown in FIG. 1) which may be one of a shoe insole configured to attach to the bands, or an external strap to secure around the foot or shoe.
3. The first elastic band consists of segments 1, 33, 30, 8, 9, 26, and 25 (herein referred to as component B1). The second continuous elastic band consists of segments 34, 3, 6, 29, 27, and 13, 14 (herein referred to as component B2). These segments form an unbroken continuous band or tube of any material or materials that provides an elastic force. The segments in the depiction of each band are meant as a representation to show that each band may be split into any number of segments, each of any length. Further, each segment may consist of any elastic, or fixed length material, as long as the resultant band B1 and/or B2 provides some type of elastic force to assist the lower extremity.
4. Elastic band B1 has an attachment point 23 for securing the band to the upper body attachment, B2 has a similar attachment point 16. The attachment points 23 and 16 are a means of securing the elastic bands B1 and B2 to any upper body attachment (described further below) and may be but are not limited to being a clip.
5. B1 contains a second attachment point 36 for securing the bottom of the elastic band B1 to the foot attachment. B2 contains a similar attachment point 35. The attachment points are any means of securing the elastic bands B1 and B2 to the foot attachment (described further below) and may be but are not limited to being a clip.
6. In the description of some components, two devices are necessary to show the full scope of the component. Thus, elastic bands B3 and B4 refer to elastic bands B1 and B2 respectively however on the second lower extremity, thus referring to a second lower extremity assistance device. The device need not be flipped in a physical application, however for the purposes of discussing the bio-mechanics of the device interacting with the leg the distinction is necessary. An example of this is the upper body attachments which can handle the assistance devices for both lower extremities.
7. The manner in which the two elastic bands B1 and B2 are positioned on the user's lower extremity (may be one or two devices, one on each lower extremity) is depicted in FIGS. 2-A and 2-B. Locations 2, 7, and 11 are "cross over" points required for the proper configuration and function of the present invention. "Cross over" points refer to a location where the elastic bands B1 and B2 cross over each other forming an x-pattern. 2 is positioned somewhere between the toe and tibialis anterior and could be raised off of, or in contact with the user's tibialis anterior. 7 is positioned roughly in the middle of both the lateral and medial heads of the gastrocnemius. Cross over point 11 is located roughly in the middle of the rectus femoris.
8. The present invention contains an upper body attachment. The first, embodiment consists of a semilunar belt 18 as the upper body attachment. The belt 18 has a means of adjusting the size (length) of the belt in component 19. The belt 18 has four attachment points, allowing for securing of one device for each lower extremity. Attachment point 22 secures to attachment point 23 of elastic band B1. Attachment point 20 secures to attachment point 16 of elastic band B2. Further, the second device attaches similarly with elastic band B3 (B1 on device 2) securing to attachment point 17, and elastic band B4 (62 on device 2) securing to attachment point 21. The attachment points 22, 21, 20, and 17 are any means of securing the elastic bands B1, B2, B3, and B4 to the upper body attachment and may be but are not limited to being clips.
9. The first embodiment of the semilunar belt 18 depicts the formation of a 'v' between the attachment points 22 and 21 as well as between attachment points 17 and 20. The present depiction of the first embodiment is meant as an example and is not intended to limit the scope of the invention as it may be necessary to move/configure these attachment points for the needs of each separate user. For example, the distance between attachment points 22 and 21, the angle between attachment points 22 and 21 and the length of the flange at attachments points 22 and 21 may all need to be adjusted to fit specific user's needs.
10. The first embodiment of the present invention contains a foot attachment shown in FIG. 6. The foot attachment consists of a wrap which stretches around the foot or shoe and conforms to the foot or shoe. It has two attachment points 52 and 53 which secure to 35 and 36 respectively, the attachment points may include but are not limited to being clips. Further, the bottom of the foot wrap is some material that has lower friction than elastic, similar to a shoe sole. The purpose of this is to avoid the foot catching on the ground and jerking the user thus avoiding disruptions in the natural gait cycle.

Figure 7:
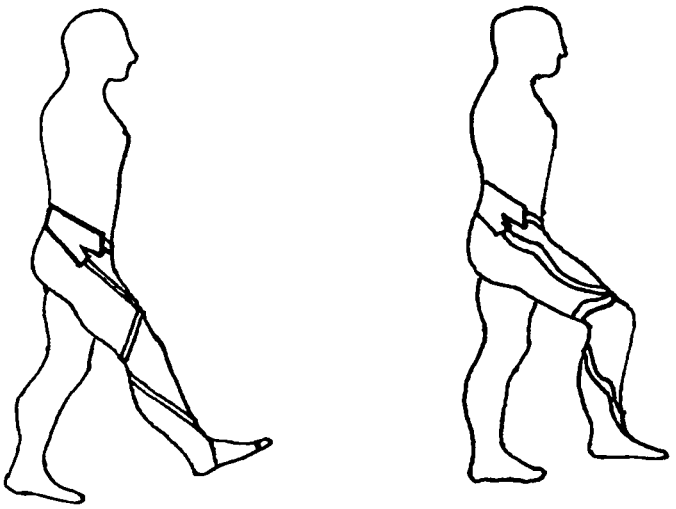
FIG. 7. Shows a general example of the device assisting one leg of a user in walking.

11. The manner in which the elastic bands B1 and B2 are configured around the lower extremity of the user, and the configuration of tension in each segments of elastic bands B1 and B2 is necessary to provide the following assistance throughout the gait cycle. A general depiction, meant as an example but not to limit the scope of the invention, is shown in FIG. 7.
    a. During the pre-swing or toe off phase of the gait cycle
        i. the segments of elastic bands B1 and B2, between the two cross over points 7 and 11, which wrap on either side of the thigh between the gastrocnemius and the middle of the rectus femoris, provide energy to the gastrocnemius and hamstrings which assist in flexing the knee.
    b. During the initial and mid-swing phase of the gait cycle
        i. the segments of elastic bands B1 and B2 between 7 and 11 continue to assist the gastrocnemius and the hamstrings.
        ii. The segments of elastic bands B1 and B2 between 11 and 15 and 11 and 23 (attachment points to the upper body attachment), which wrap from the middle of the rectus femoris around the thigh up to or past the hip, provide energy to the iliopsoas, the rectus femoris, and the sartorius to flex the hip.
        iii. The segments of B1 and B2 between 7 and 35, and 7 and 36 (attachment points to the foot attachment), which connect from the middle of the gastrocnemius to either side of the ball of the foot, provides energy to the tibialis anterior, the extensor hallucis longus, and the extensor digitorum longus to dorsiflex the ankle. This allows clearance between the toe and ground to prevent disruptions in the natural gait cycle. These segments (between 7 and 35 and 7 and 36) also provide neutralization of inversion and eversion of the ankle. The tension in B1 and B2 between 7 and 11 can be adjusted to neutralize any abnormal rotation of the knee. This is accomplished by having more tension in either of the elastic bands B1 or B2 (through said segments) depending on if the user has excess internal or external rotation of the knee
    c. During the terminal swing phase of the gait cycle
        i. The segments of elastic bands B1 and B2 between 11 and 15 and 11 and 23 continue to provide energy to the iliopsoas, the rectus femoris, and the sartorius to flex the hip.
        ii. Resistance to the quadriceps during knee extension provides neural feedback which in turn encourages the quadriceps to engage during knee extension at the terminal swing.
12. A second embodiment of the present invention consists of having each cross over point 2, 7, and 11 secured in place by some means of securing that may be but is not limited to a clip. Adjusting and securing the cross over points allows for the device to be configured to fit each user properly, as well as provides a means of customizing how much energy in provided to each muscle group in the lower extremity. The adjustability in this sense allows shifting the amount of compensation between each of hip flexion assistance, knee flexion assistance, and ankle dorsiflexion assistance. It also allows for different levels of tension in the segments of elastic bands B1 and B2 between the upper body attachment, and the cross over point 11. The difference in tension between these two segments provides a means to maintain a neutral hip throughout the gait cycle since it may compensate for muscular problems resulting in a naturally over adducted or abducted hip or greater internal or external rotation at the hip. Higher tension in B1 between 7 and 23 compensates for an overly adducted hip, while more tension in B2 between 7 and 16 corrects excess abduction of the user's hip.
13. A third embodiment of the present invention consists of elastic band B1 containing a tension adjusting component 24, refer to FIG. 1. The tension adjusting component is a means of shortening or lengthening the at rest length of the active section of the elastic band B1, which in turn increases or decreases the energy provided to the user's lower extremity muscles. Elastic band B2 contains a similar tension adjusting component 15. The depiction in FIG. 1 is meant as an example and by no means limits the scope of the present invention to an exact replication of the component shown.
14. A fourth embodiment of the present invention contains two more tension adjusting components, similar to 24 and 15. There is an additional tension adjusting component located on each of the elastic bands B1 and B2, which are 32 and 4 respectively. The location of the tension adjusting components 32 and 4 are depicted as an example and are not limited to that shown in FIG. 1. The addition of these components allows for the correction of pronation and supination helping maintain a neutral ankle during dorsiflexion. This is accomplished by applying more tension in the segment contained between 7 and the foot attachment, in either B1 or B2, which helps correct pronation, and supination respectively.
15. Another embodiment of the present invention contains the upper body attachment as a shoulder harness 45 shown in FIGS. 3-A, 3-B, and 4. The shoulder harness 45 consists of two loop like straps 37 and 38 that are secured around the user's left and right shoulder respectively, while the bottom of the straps rest on the anterior ribcage of the respective body side. 37 and 38 are secured together through a third strap, 43, which has a length adjusting component, 44, which varies the distance between 37 and 38 allowing configuration to the needs of the user. The length adjusting strap consisting of 43 and 44 rests roughly across the user's scapula, and is necessary in order to counteract the forward and downward pull that the elastic bands B1, B2, B3, and B4 induce on the shoulders, therefore maintaining a good neutral posture in the user. The shoulder harness 45 also contains 4 attachment points 39, 40, 41 and 42 which provide the same function as 21, 22, 20 and 17 respectively, from the semilunar belt 18, and thus are not limited to being but may be a clip of some variety.
16. Another embodiment of the present invention includes a foot attachment with rigid components shown in FIGS. 5-A and 5-B. The replacement foot attachment consists of a trimmable rigid insole, which provides the ability to fit in any shoe. The insole contains two attachment points, 48 and 50, on the bottom side of the near the ball of the foot, which secure to 36 and 35 of elastic bands B1 and B2 respectively. The attachment points may include but are not limited to being clips.
17. Another embodiment of the present invention contains pressure dispersion pads. Examples of pressure dispersion pads are throughout the figures, but referring to FIG. 1 the pressure dispersion pads are exemplified by components 5, 31, 10, 28, and 12. FIG. 1 shows the pressure dispersion pads being located in rather random positions on the device. This is meant to depict that these pressure dispersion pads may be placed anywhere on the elastic bands B1 between 36 and 1, and anywhere on elastic band B2 between 15 and 35. The configurability allows for pressure dispersion pads to be placed anywhere on the device that the user experiences excess pressure causing discomfort. Lastly, the pressure dispersion pads work to disperse the forces from the elastic band, thereby reducing the pressure experienced by the user 18. Another embodiment of the of the present invention contains the cross over point securing components 2 and/or 7 and/or 11 that double as a pressure dispersion pad in the form of an 'x'. This provides the same benefits as the pressure dispersion pad 5 described above for the cross over points.

19. In any description above, if elastic bands B3 and B4 were not discussed then they have the same function and capabilities as elastic bands B1 and B2 respectively. This was in an effort to simplify the description as well as show that a user may have only one lower extremity assisted or may have both lower extremities assisted.

The invention claimed is:

1. A device for promoting a natural gait cycle by engagement with a leg of a user, the device comprising:

two discrete bands configured to be wrapped around the leg in a cross form pattern with one end of each band being secured to an upper attachment point and the other end of each band being secured to a lower attachment point;

the lower attachment point comprising a rigid sole insole or an external shoe cuff;

the upper attachment point comprising a pair of contact points on an adjustable semilunar belt or an adjustable shoulder strap; and the cross form pattern having first, second and third crossover locations, the first crossover location configured to lie on an anterior tibialis of the leg, the second crossover location configured to lie on a gastrocnemius of the leg, and the third crossover location configured to lie on a middle to upper quadriceps of the leg when worn by the user such that the bands extend from the lower attachment point to the first crossover location, wrap around the leg from opposed sides of the leg to the second crossover location, further extend around opposed sides of the quadriceps of the leg to the third crossover location and then extend to the upper attachment point.

2. The device of claim 1, wherein the bands are adjustable at the upper attachment point to increase or decrease a level of tension in the bands.

3. The device of claim 2, further comprising means for adjustably securing the bands at the first and second crossover locations.

4. The device of claim 1, further comprising pressure dispersion pads configured to be interposed between the bands and the leg.

5. The device of claim 1, wherein each band includes at least one portion with a different tensile property than other portions of the band.

6. A method of using the device of claim 1, the method comprising:

attaching the other end of each band being secured to the lower attachment point;

wrapping the bands around the leg in the cross form pattern; and, attaching the one end of each band to the upper attachment point.

* * * * *